US006517074B1

(12) United States Patent
Moody et al.

(10) Patent No.: US 6,517,074 B1
(45) Date of Patent: Feb. 11, 2003

(54) ELECTRONIC VIDEO POKER GAMES

(76) Inventors: Ernest W. Moody, 2116 Redbird Dr., Las Vegas, NV (US) 89134; Michael W. Wood, 1106 Willowbrook Ave., Denham Springs, LA (US) 70726

( * ) Notice: Subject to any disclaimer, the term of this patent is extended or adjusted under 35 U.S.C. 154(b) by 239 days.

(21) Appl. No.: 09/514,860

(22) Filed: Feb. 28, 2000

Related U.S. Application Data

(63) Continuation-in-part of application No. 09/175,226, filed on Oct. 20, 1998, now Pat. No. 6,098,985, which is a continuation-in-part of application No. 09/083,531, filed on May 22, 1998, now Pat. No. 6,007,068, and a continuation-in-part of application No. 08/495,952, filed on Jun. 28, 1995, now Pat. No. 5,531,448, and a continuation-in-part of application No. 08/755,174, filed on Nov. 25, 1996, now Pat. No. 5,732,950, and a continuation-in-part of application No. 08/900,965, filed on Jul. 25, 1997, now Pat. No. 5,823,873.

(60) Provisional application No. 60/019,879, filed on Jun. 17, 1996.

(51) Int. Cl.[7] ..... A63F 1/00

(52) U.S. Cl. ..... 273/292; 273/274; 463/12; 463/13

(58) Field of Search ..... 463/13, 12; 273/292

(56) References Cited

U.S. PATENT DOCUMENTS 5,816,915 A * 10/1998 Kadlic ..... 463/13

6,050,568 A * 4/2000 Hachquet ..... 273/292

* cited by examiner

*Primary Examiner*—Benjamin H. Layno
*Assistant Examiner*—Dolores R. Collins
(74) *Attorney, Agent, or Firm*—John Edward Roethel

(57) ABSTRACT

A card game is described in which the player plays multiple hands of cards. At the beginning of each round of the game, the player determines how many times the player wishes to play the initial deal of the cards and makes an appropriate wager to cover those multiple plays of the initial hand of cards. One hand of five cards is dealt, all five cards face up. The player selects none, one or more of the face up cards from the first hand as cards to be held. Replacement cards for the non-selected cards are dealt into the first hand and the poker hand ranking of the first hand is determined. The initial deal of cards is then re-used and becomes a second hand. The player again selects none, one or more of the face up cards from the second hand as cards to be held. Replacement cards for the non-selected cards are dealt into the second hand and the poker hand ranking of the second hand is determined. These steps are repeated until the player has completed play of all of the hands that the player initial chose to play. The player is paid for any winning poker hands based on a pay table and the amount of the player's wager on each hand. Alternatively, the method of the present invention can also be applied to three card poker or four card poker.

8 Claims, 12 Drawing Sheets

ELECTRONIC VIDEO POKER GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of application Ser. No. 08/900,965, entitled "Electronic Video Poker Games", filed Jul. 25, 1997, now U.S. Pat. No. 5,823,873; and is also a Continuation-in-Part of application Ser. No. 09/083,531, entitled "Electronic Video Poker Games", filed May 22, 1998, now U.S. Pat. No. 6,007,068; and is also a Continuation-in-Part of application Ser. No. 09/175,226, entitled "Electronic Video Poker Games", filed Oct. 20, 1998, now U.S. Pat. No. 6,098,985 now pending. The disclosure of each of these earlier patents and/or applications is incorporated herein by this reference, with each of these earlier applications being commonly owned with this application.

BACKGROUND OF THE INVENTION

This invention relates primarily to electronic video poker games, and more particularly to electronic video poker games that are based on poker hand rankings and that allow the player to discard and replace unwanted cards with replacement cards. The present invention has many versions with the common thread being that cards from an initial hand of cards are re-used in one or more subsequent or additional hands to allow the player the opportunity to play one or more cards from the starting hand of cards multiple times. The invention also involves features which may apply to casino table games as well.

SUMMARY OF THE INVENTION

The method of the present invention involves a card game in which the player plays multiple hands of cards. At the beginning of each round of the game, the player determines how many hands the player wishes to play, i.e. how many times the player wishes to play the initial deal of the cards. The player makes an appropriate wager to cover those multiple plays of the initial hand of cards. One hand of five cards is dealt, all five cards face up. The player selects none, one or more of the face up cards from the first hand as cards to be held. Replacement cards for the non-selected cards are dealt into the first hand and the poker hand ranking of the first hand is determined.

The initial deal of cards is then re-used and becomes a second hand. The player again selects none, one or more of the face up cards from the second hand as cards to be held. Replacement cards for the non-selected cards are dealt into the second hand and the poker hand ranking of the second hand is determined.

These steps are repeated until the player has completed play of all of the hands that the player chose to play. The player is paid for any winning poker hands based on a pay table and the amount of the player's wager on each hand.

Alternatively, the method of the present invention can also be applied to three card poker or four card poker.

DETAILED DESCRIPTION OF THE PREFERRED EMBODIMENTS

The present invention includes a variety of electronic video poker games each having multiple hands in which the initial deal of cards is replayed by the player a multiple number of times. Each electronic video poker game is designed to be played by having the hands displayed on a video screen to a player. The player makes a wager that is allocated among one or more hands as determined by the player. A deck of cards is electronically shuffled and an initial five card hand is selected randomly and displayed to the player. By manipulating the buttons on the button panel of the gaming device or by using conventional touch screen technology, the player selects which cards he wishes to hold and, thus, which cards he wishes to discard. The player activates a draw button and replacement cards are then displayed for the discarded cards forming the first five card hand. This first final five card hand is analyzed for poker hand ranking and the outcome of the play of the hand is determined.

The initial five cards are then redisplayed on the video screen and the player again holds the cards he wishes to keep, if any. Replacement cards are again dealt and a final five card is displayed. This resulting second final five card hand is analyzed for poker hand ranking and the outcome of the play of the hand is determined.

The redisplay of the initial five card hand, the draw step and the resulting five card hand are played over until all of the hands wagered on by the player have been played out.

The player wins awards based on the poker hand rankings of the completed hands and the amount wagered by the player on each hand using a pay table that is displayed to the player.

Figure 1:
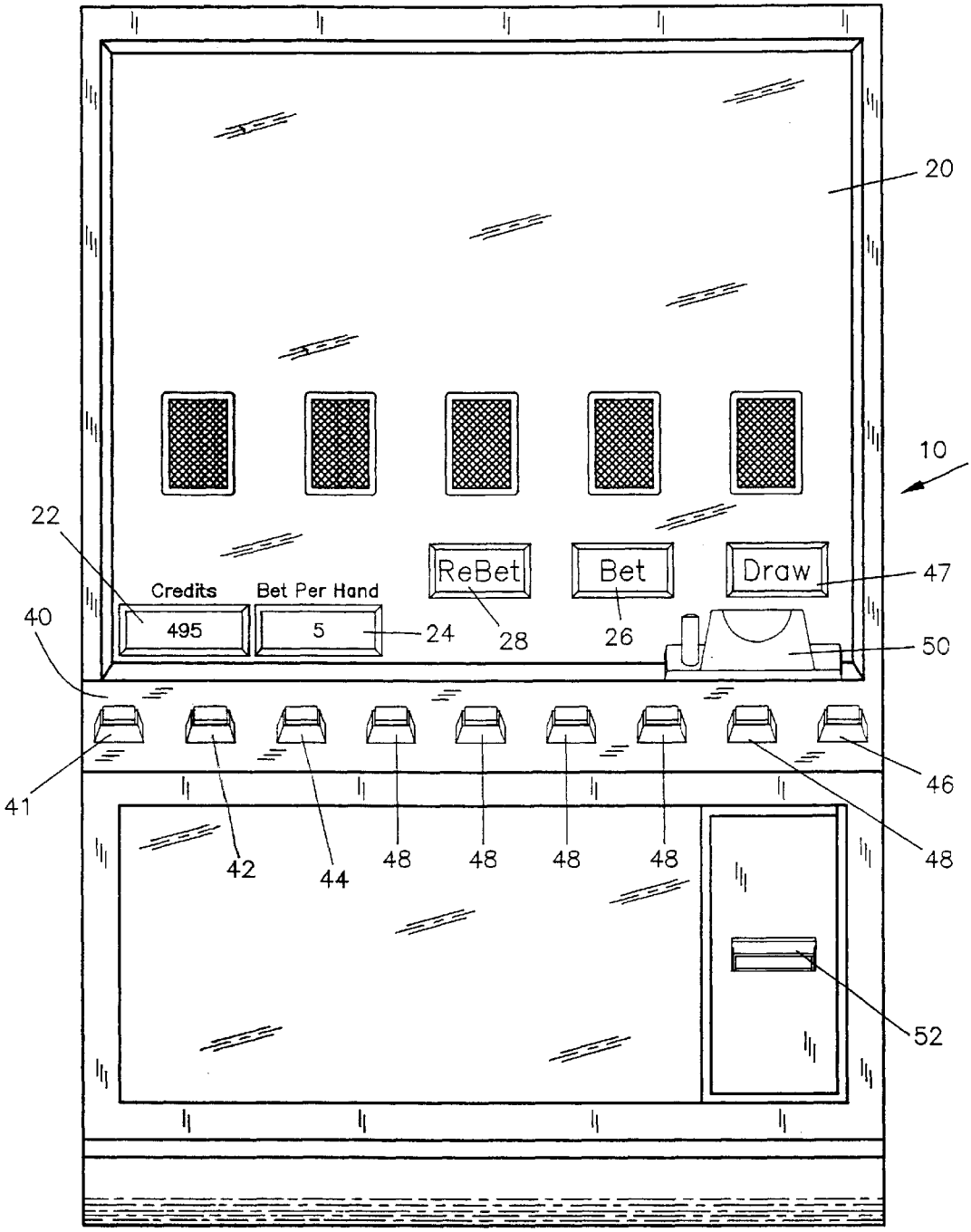
FIG. 1 shows a gaming machine that can be used to practice the method of the present invention.

FIG. 1 shows a gaming show upon which the method of the present invention can be carried out. The gaming machine 10 includes a video screen display 20 on which are shown the playing cards that will be used during the play of the method of the present invention. The video screen display 20 also includes other information and data presented to the player to allow the player to understand the play of the game and to effect the operation of the method.

In the preferred embodiment of the present invention, the video screen display shows a credit meter 22 and a display 24 of the number of credits bet per hand. The video screen display also has touch screen locations to allow the player to DRAW 47 replacement cards, to make his initial BET 26 and to make a REBET 28. Each of the card locations on the video screen display can also be touch screen locations so that the player may designate which cards he wishes to hold by merely touching the card location on the video screen display 20.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allows the player to wager either the maximum amount of credits or to wager one credit at a time on the play of the game as desired by the player. A DRAW button 46 is provided to allow the player to effect the draw step of the method of play as desired should the player prefer to use the button panel instead of the DRAW touch screen location 47 on the video screen display 20. A plurality of HOLD buttons 48 are also provided to allow the player to select which cards the player wishes to hold should the player prefer to use the button panel instead of the card touch screen locations on the video screen display 20.

In the preferred embodiment of the present invention, when the initial five card hand is displayed on the video screen display 20, the player must choose which cards to hold by either pressing the card location on the touch screen or by pressing the HOLD button associated with the card position. Alternatively, it is possible to provide what is known as an "Auto-hold" feature to the method of play. When an "Auto-hold" is in use, the computer controls of the gaming machine analyze the initially displayed hand and suggest a HOLD to those cards that would give the player the best mathematical probability for that initial hand based on the pay table that is being used. The player can accept the suggested "Auto-hold" by pressing the DRAW location or the DRAW button and the draw step will take place. If the player declines the suggested "Auto-hold", the player must unhold any cards that were held by the "Auto-hold" if the player wishes to discard those cards and the player must manually hold any other cards that the player wishes to hold. The use of an "Auto-hold" feature speeds up play by increasing the number of hands per hour that can be played on the gaming machine.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

Any other conventional and suitable equipment can be included in the gaming machine.

Version #A: The method of play of a preferred embodiment of the present invention will now be described. A player makes an initial selection of the number of hands the player wishes to play. The player may determine to play one or more hands. The gaming machine 10 may be configured to allow play of any number of hands, but in the preferred embodiment of the present invention, the player may select to play from one to five hands. This selection is made by making an appropriate wager by using the BET MAX button 42, the BET ONE button 44 multiple times, or by touching either the BET location 26 or the REBET location 28 on the video screen display 20. The REBET location 28 is provided to allow the player a quick and easy selection mode to simply again wager the same amount on the same number of hands that the player had played on the previous round of the game.

In the example shown in FIGS. 2–12, the player has made a wager of twenty-five credits which have been allocated as five credits wagered on each of five hands.

Figure 2:
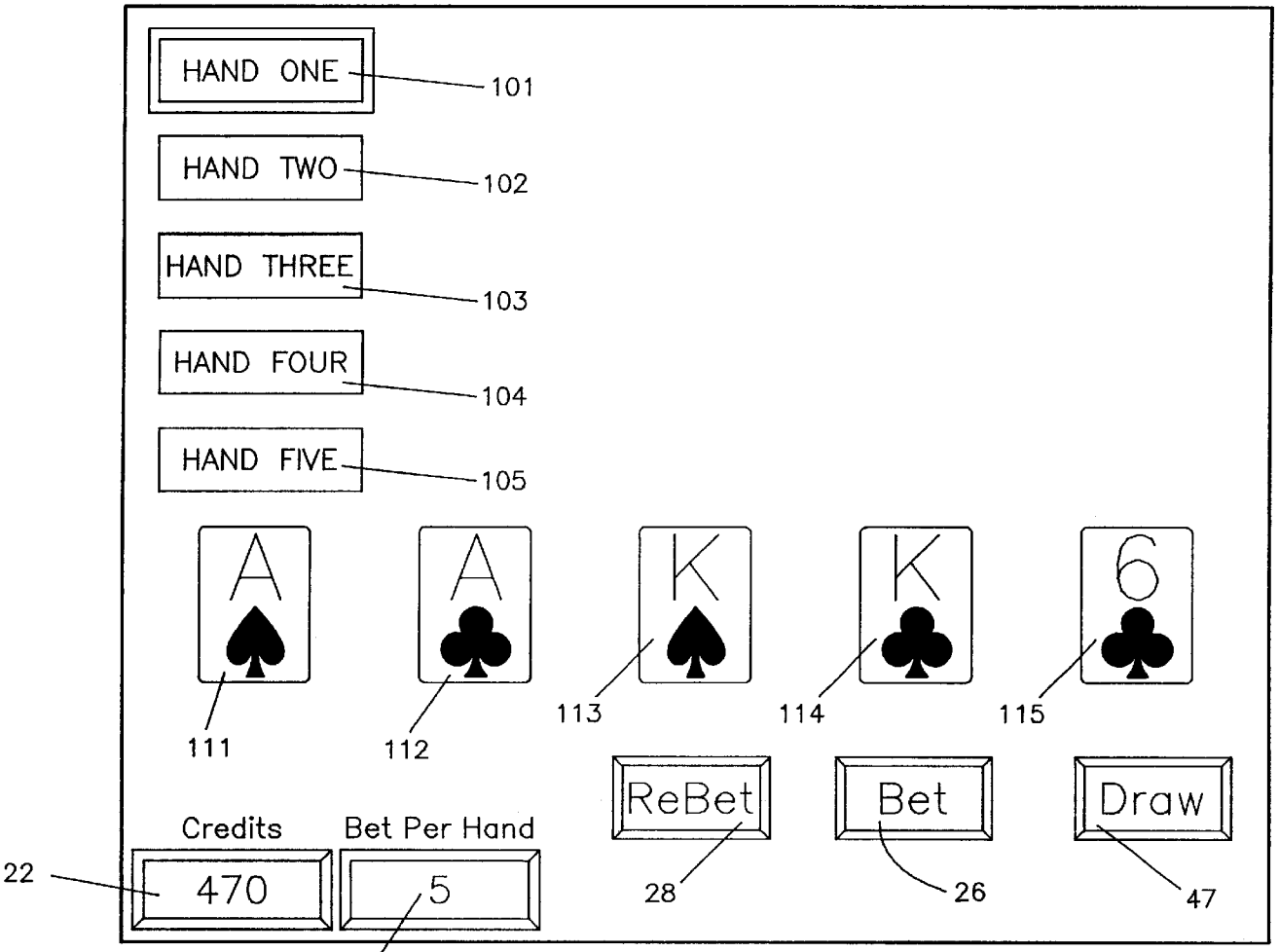
FIG. 2 shows the screen display for Version #A of the present invention after the initial deal of the cards for Hand #1.

The computer controls randomly shuffle a deck of cards and the play of HAND ONE now begins. As shown in FIG. 2, the HAND ONE symbol 101 is highlighted to indicate that HAND ONE is now being played. An initial deal of five cards is displayed on the video screen 20. For example as shown in FIG. 2, the initial five cards could be the Ace of Spades 111, the Ace of Clubs 112, the King of Spades 113, the King of Clubs 114 and the Six of Clubs 115.

Figure 3:
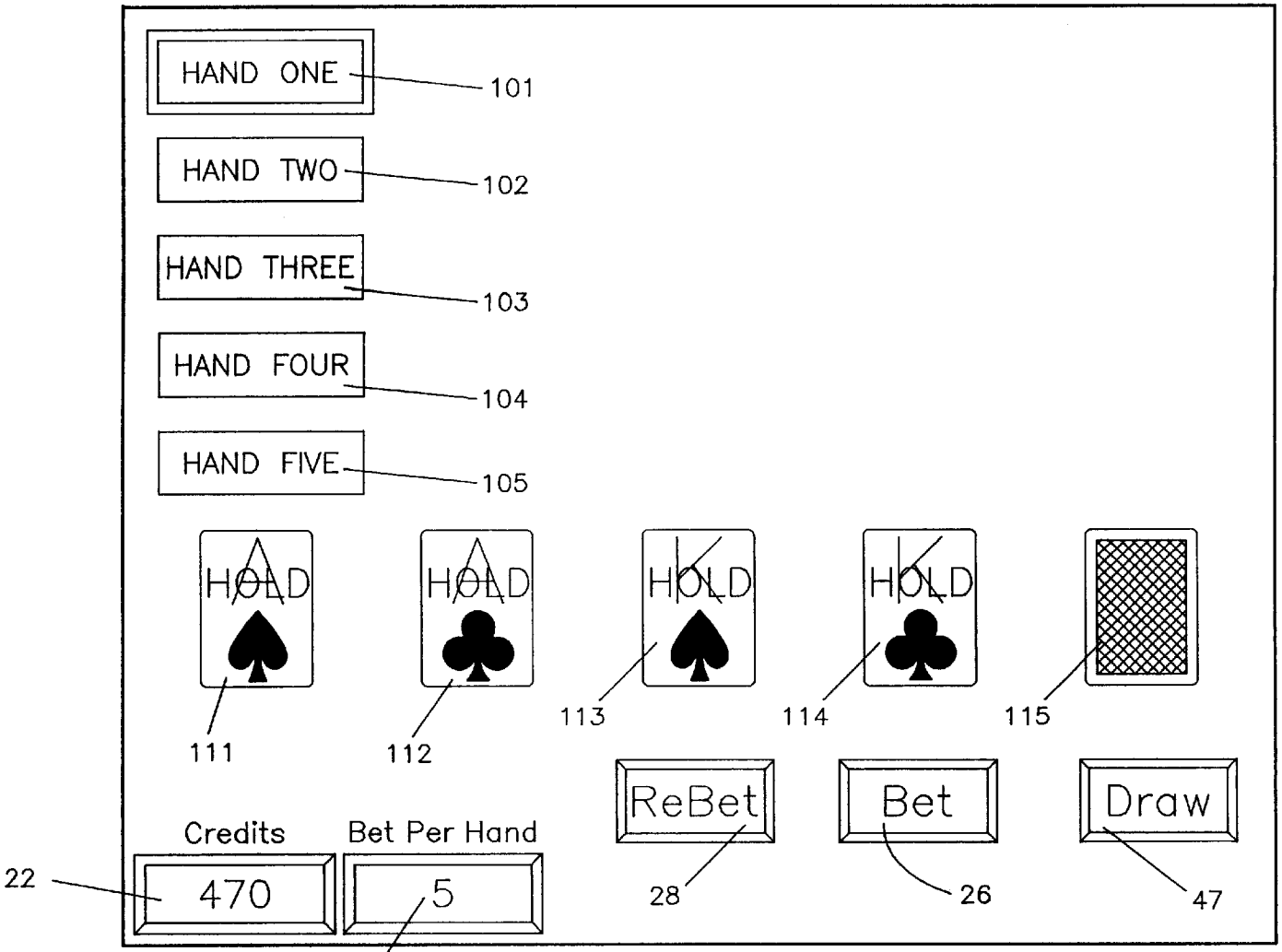
FIG. 3 shows the screen display for Version #A after the player has selected the cards he wishes to hold in Hand #1.

The player then selects which of these initial five cards the player wishes to hold. As shown in FIG. 3, the player has held the Ace of Spades 111, the Ace of Clubs 112, the King of Spades 113 and the King of Clubs 114. When the player has completed choosing the cards he wishes to hold, the player activates the DRAW button and a replacement card is dealt for the discarded card 115.

Figure 4:
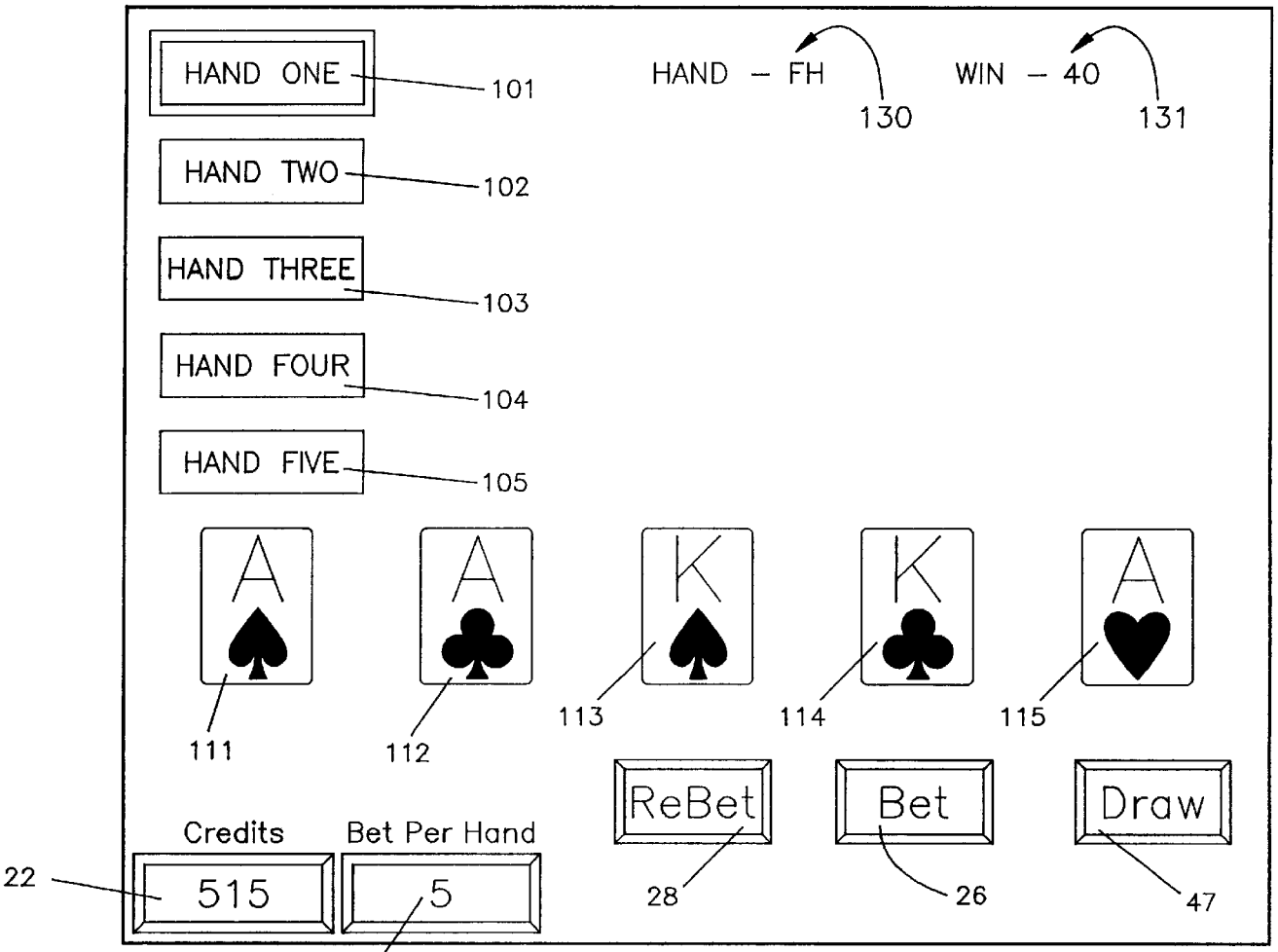
FIG. 4 shows the screen display for Version #1 after replacement cards have been dealt resulting in the final five cards for Hand #1.
Figure 5:
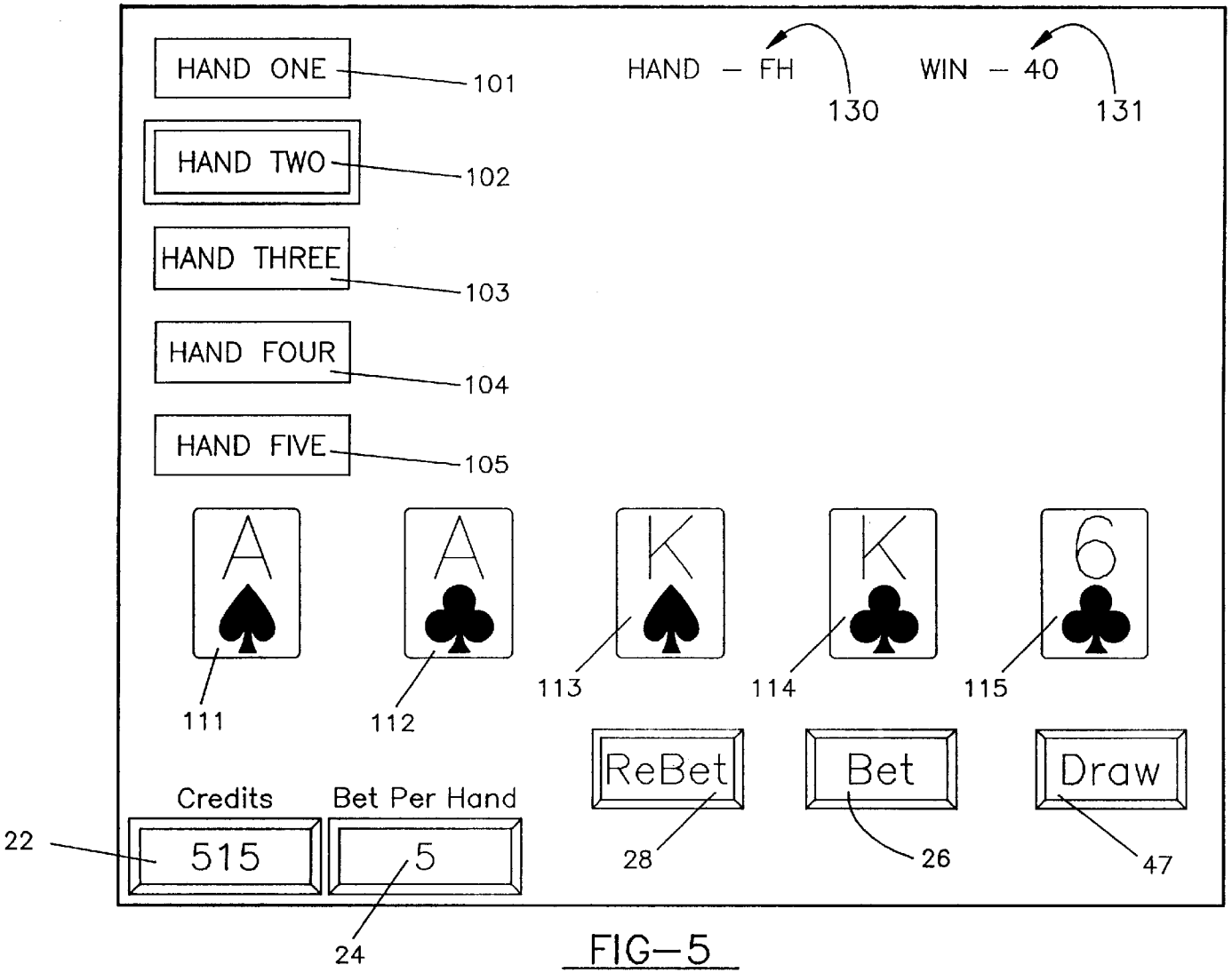
FIG. 5 shows the screen display for Version #1 in which the initial five cards are re-used in Hand #2.

As shown in FIG. 4, the player has received the Ace of Hearts 116 as the replacement card and the player has achieved a Full House. The results of HAND ONE are shown in an appropriate location on the video screen, such as at location 130 adjacent HAND ONE symbol 101, and the amount won by the player is also shown at an appropriate location on the video screen, such as at location 131, also adjacent HAND ONE symbol 101.

The amount won the player for a winning hand combination is based on the poker hand ranking achieved by the player and the number of coins, tokens or credits wagered by the player. A pay table is shown to the player in any suitable manner such as the pay table being imprinted on the display glass of the gaming machine 10 or being shown on the video screen display 20. A representative pay table is shown in Table 1:

TABLE 1

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH ANY 2, 3 OR 4 | 400 | 800 | 1200 | 1600 | 2000 |
| FOUR 2'S, 3'S OR 4'S WITH ANY ACE, 2, 3 OR 4 | 160 | 320 | 480 | 640 | 800 |
| FOUR ACES | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 8 | 16 | 24 | 32 | 40 |
| FLUSH | 5 | 10 | 15 | 20 | 25 |

TABLE 1-continued

| POKER HAND | NUMBER OF COINS BET 1 | 2 | 3 | 4 | 5 |
|---|---|---|---|---|---|
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The pay table shown in Table 1 is a preferred pay table when the method of play of the present invention is applied to a Double Double Bonus Draw Poker format, but any suitable pay table can be used.

Using the pay table shown in Table 1, the player would win forty credits for achieving a Full House in HAND ONE 101 and the winning amount of forty credits would be accrued on the credit meter 22.

The play of the game now proceeds to HAND TWO at which time the HAND TWO symbol 102 is highlighted to indicate that HAND TWO is now being played. The original initial five cards are now re-displayed on the video screen, so that the player has the same starting five cards. As shown in FIG. 5, the video screen again displays the Ace of Spades 111, the Ace of Clubs 112, the King of Spades 113, the King of Clubs 114 and the Six of Clubs 115. The player then chooses which of the cards the player wishes to hold, if any, and which cards the player wishes to discard.

Figure 6:
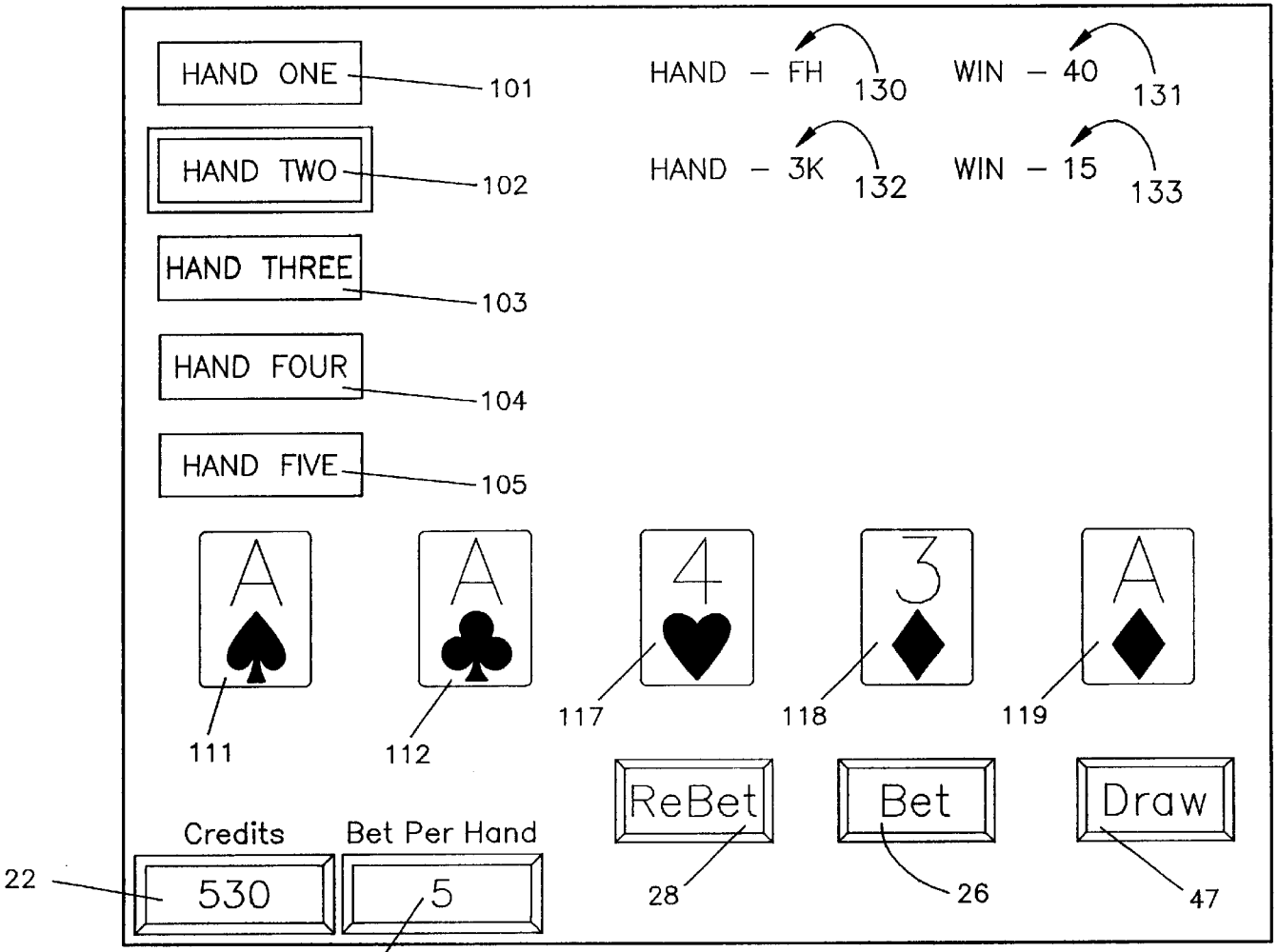
FIG. 6 shows the screen display for Version #1 after replacement cards have been dealt resulting in the final five cards for Hand #2.
Figure 7:
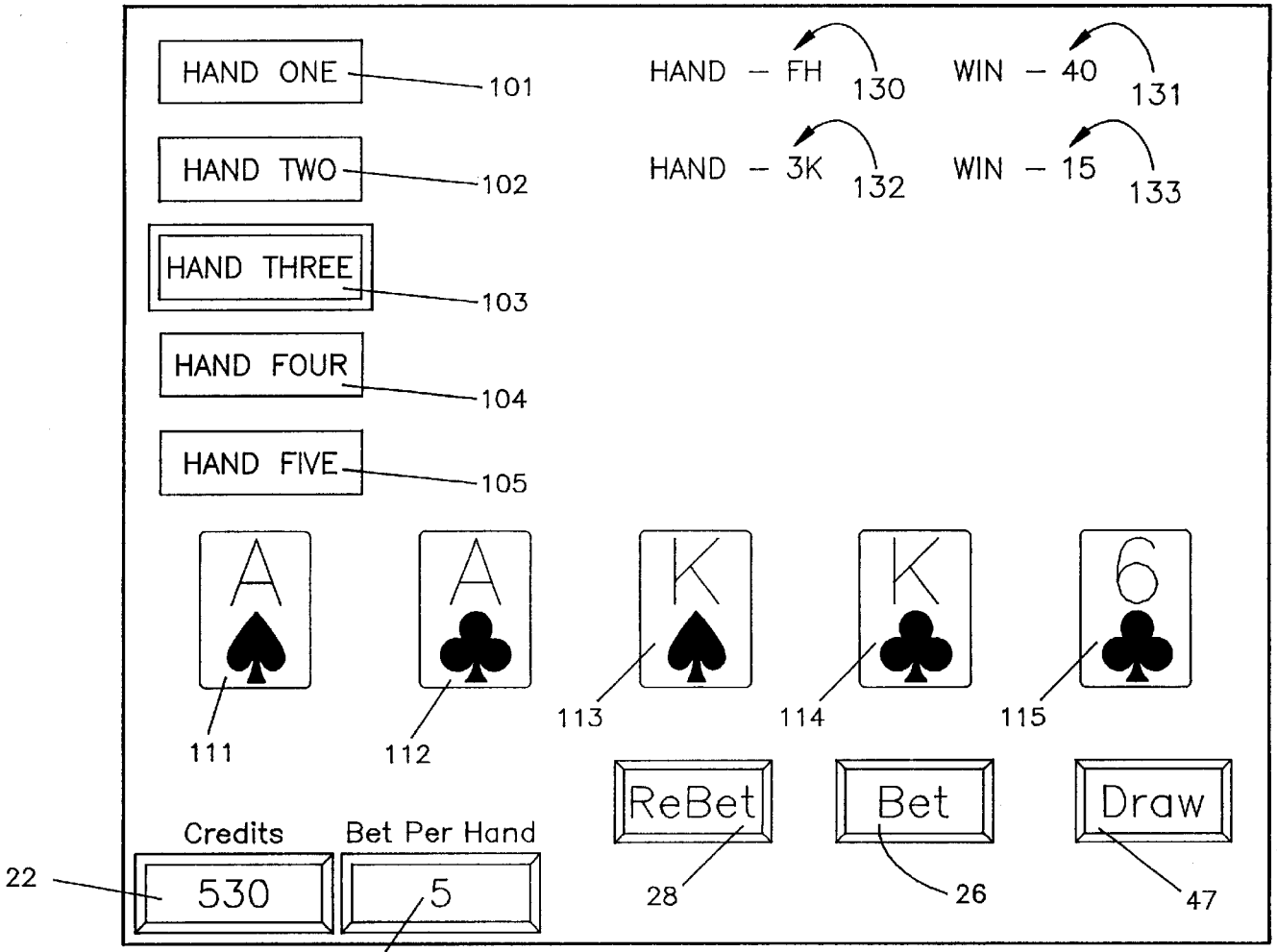
FIG. 7 shows the screen display for Version #1 in which the initial five cards are re-used in Hand #3.

Proceeding to FIG. 6, the player has this time held only the Ace of Spades 111 and the Ace of Clubs 112. When the replacement cards are dealt, the player received a Four of Hearts 117, a Three of Diamonds 118 and an Ace of Diamonds 119. The final five cards of HAND TWO comprise a Three-of-a-Kind. Based on a five credit wager on HAND TWO 102, the player would win fifteen credits for a Three-of-a-Kind and the winning amount would be accrued on the credit meter 22. The results of HAND TWO are shown in an appropriate location on the video screen, such as at location 132 adjacent HAND TWO symbol 102, and the amount won by the player is also shown at an appropriate location on the video screen, such as at location 133, also adjacent HAND TWO symbol 102.

The play of the game now proceeds to HAND THREE at which time the HAND THREE symbol 103 is highlighted to indicate that HAND THREE is now being played. The original initial five cards are again re-displayed on the video screen, so that the player has the same starting five cards. As shown in FIG. 7, the video screen again displays the Ace of Spades 111, the Ace of Clubs 112, the King of Spades 113, the King of Clubs 114 and the Six of Clubs 115. The player then chooses which of the cards the player wishes to hold, if any, and which cards the player wishes to discard.

Figure 8:
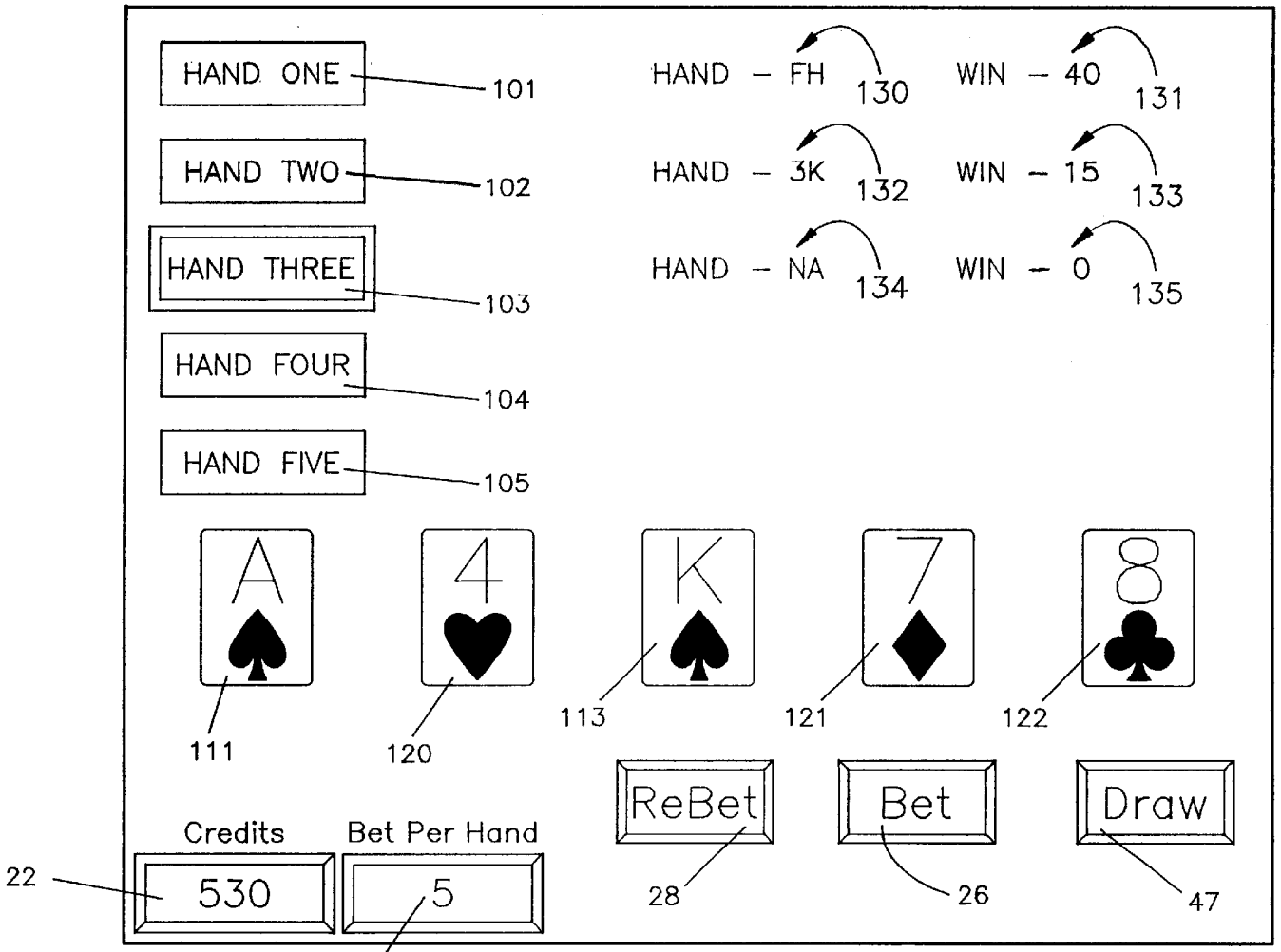
FIG. 8 shows the screen display for Version #1 after replacement cards have been dealt resulting in the final five cards for Hand #3.
Figure 9:
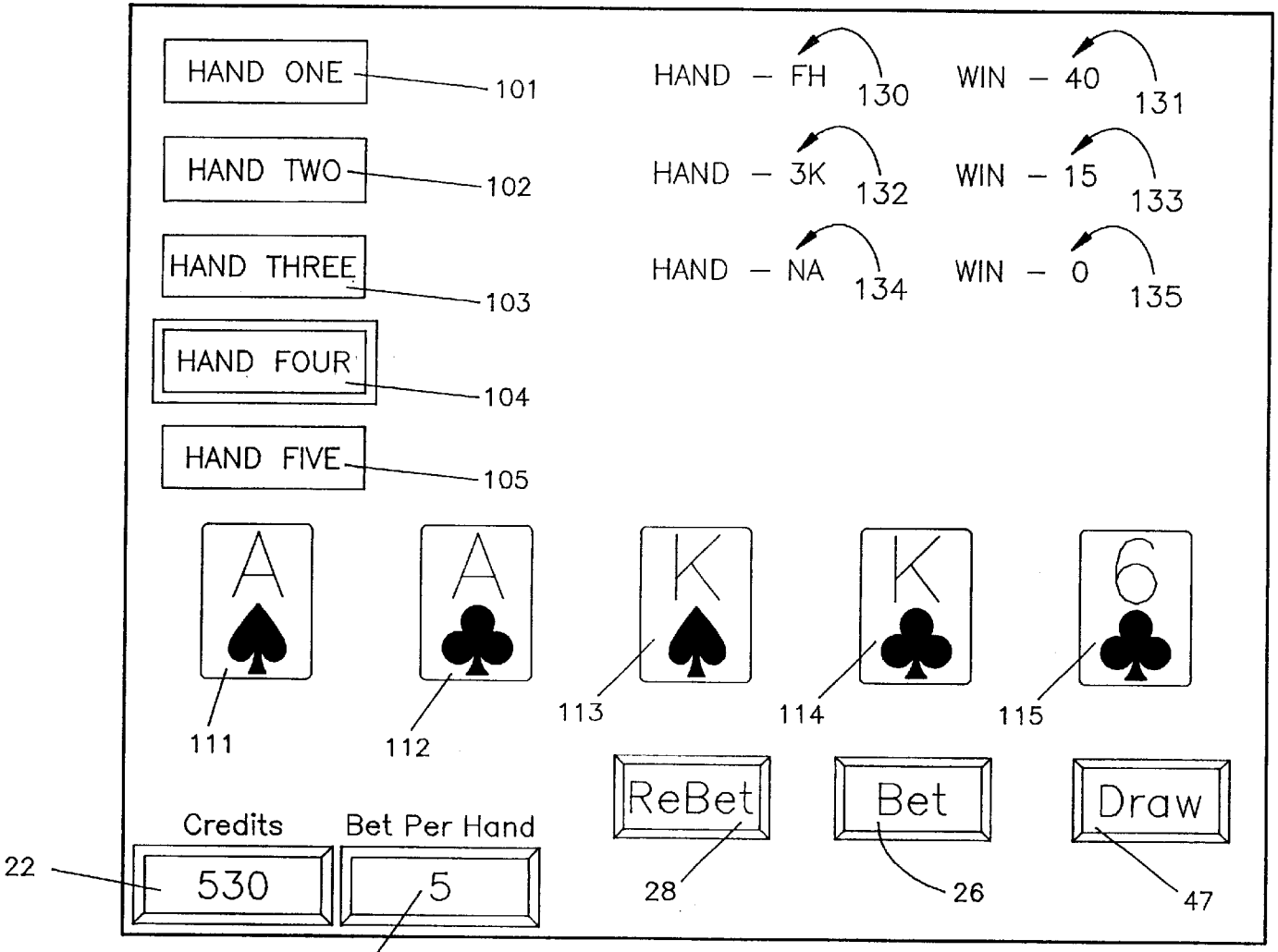
FIG. 9 shows the screen display for Version #1 in which the initial five cards are re-used in Hand #4.

Proceeding to FIG. 8, the player has this time held only the Ace of Spades 111 and the King of Spades 113. When the replacement cards are dealt, the player received a Four of Hearts 120, a Seven of Diamonds 121 and an Eight of Clubs 122. The final five cards of HAND THREE comprise an Ace High. Based on a five credit wager on HAND THREE 103, the player would have a losing hand. The results of HAND THREE are shown in an appropriate location on the video screen, such as at location 134 adjacent HAND THREE symbol 103, and the amount won by the player is also shown at an appropriate location on the video screen, such as at location 135, also adjacent HAND THREE symbol 103.

The play of the game now proceeds to HAND FOUR at which time the HAND FOUR symbol 104 is highlighted to indicate that HAND FOUR is now being played. The original initial five cards are again re-displayed on the video screen, so that the player has the same starting five cards. As shown in FIG. 9, the video screen again displays the Ace of Spades 111, the Ace of Clubs 112, the King of Spades 113, the King of Clubs 114 and the Six of Clubs 115. The player then chooses which of the cards the player wishes to hold, if any, and which cards the player wishes to discard.

Figure 10:
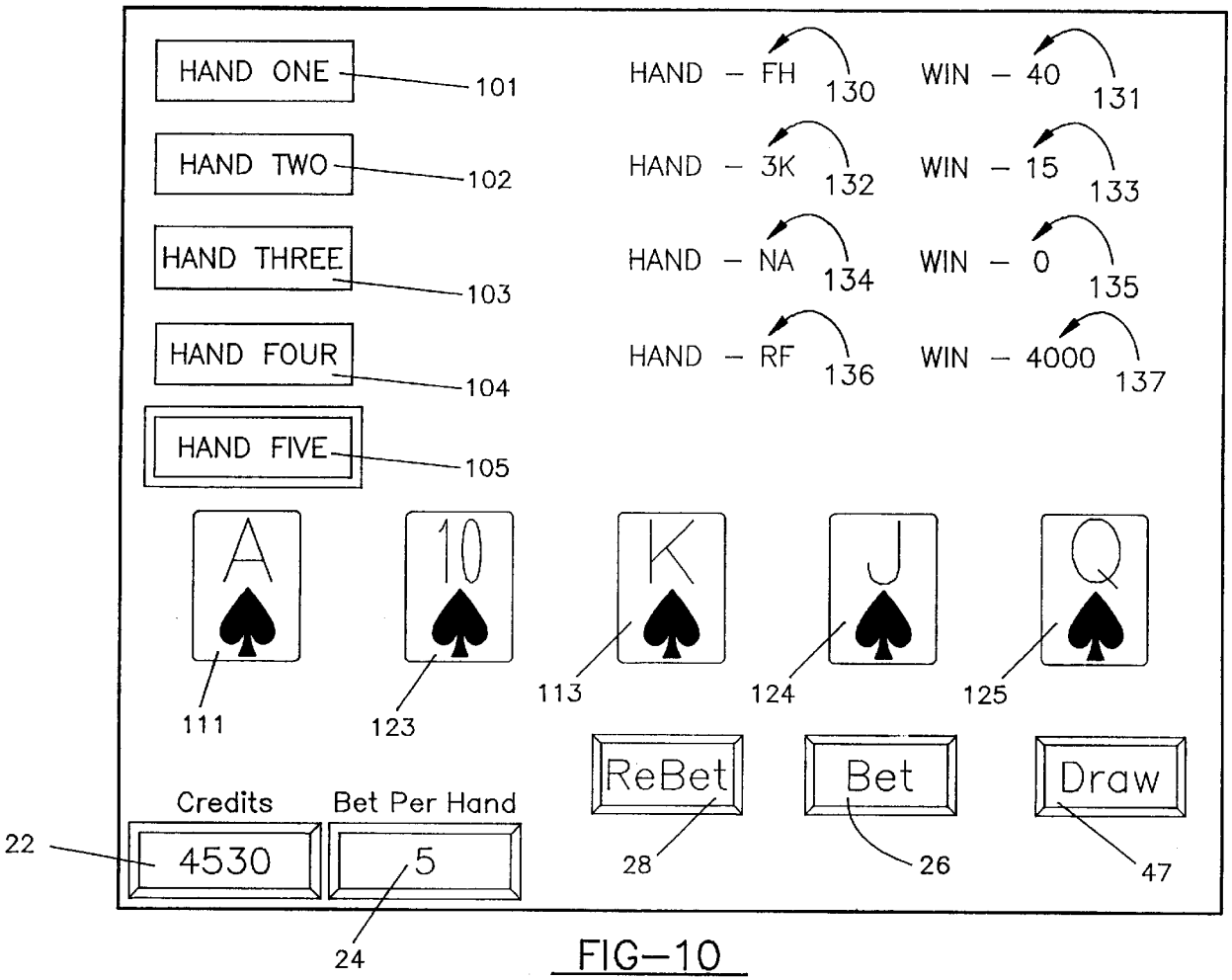
FIG. 10 shows the screen display for Version #1 after replacement cards have been dealt resulting in the final five cards for Hand #4.
Figure 11:
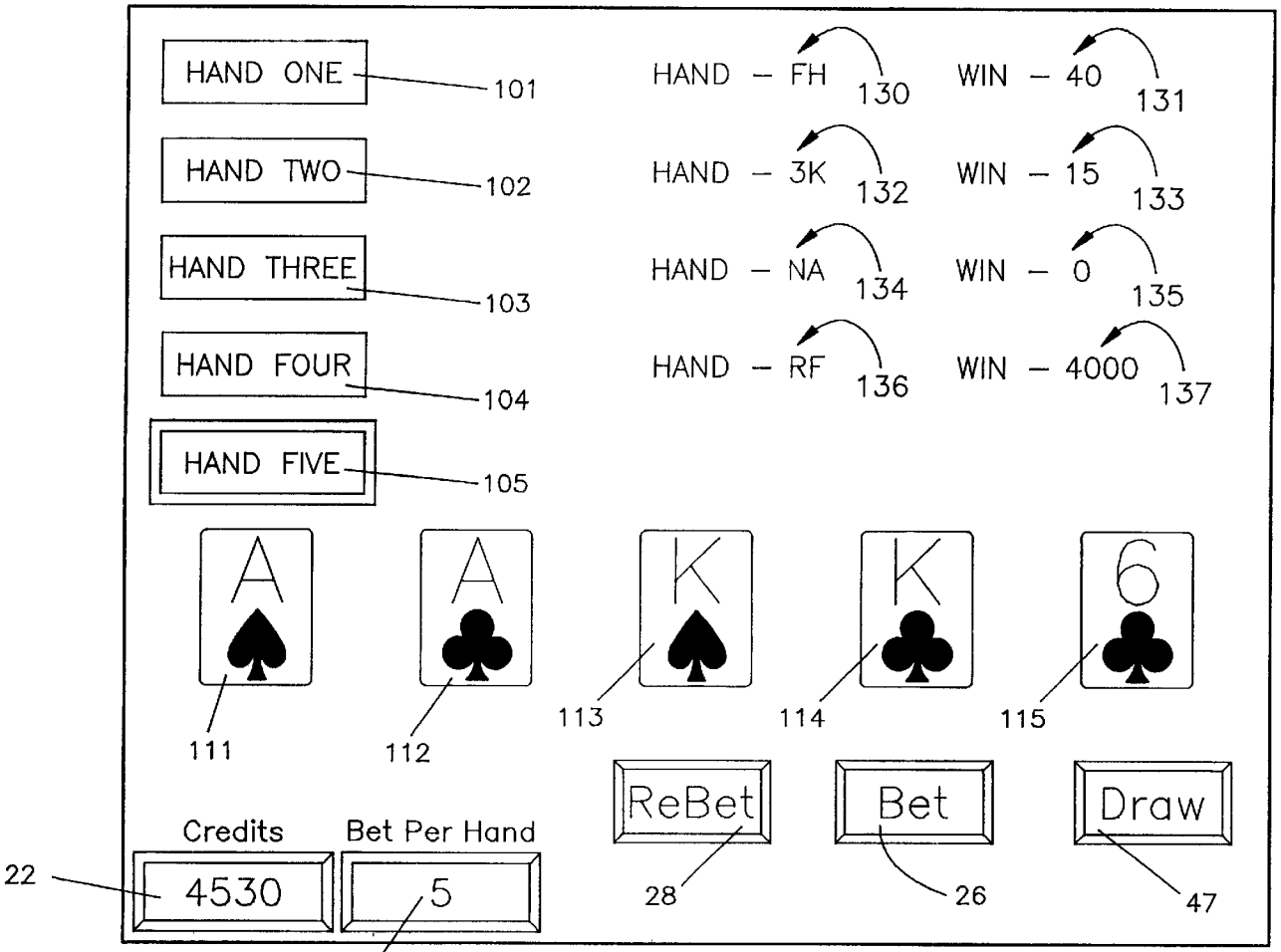
FIG. 11 shows the screen display for Version #1 in which the initial five cards are re-used in Hand #5.

Proceeding to FIG. 10, the player has this time again has held only the Ace of Spades 111 and the King of Spades 113. When the replacement cards are dealt, the player received a Ten of Spades 123, a Jack of Spades 124 and a Queen of Spades 125. The final five cards of HAND FOUR comprise a Royal Flush. Based on a five credit wager on HAND FOUR 103, the player would win four thousand credits for a Royal Flush and the winning amount would be accrued on the credit meter 22. The results of HAND FOUR are shown in an appropriate location on the video screen, such as at location 136 adjacent HAND FOUR symbol 104, and the amount won by the player is also shown at an appropriate location on the video screen, such as at location 137, also adjacent HAND FOUR symbol 104.

Finally, the play of the game proceeds to HAND FIVE which is the last of the five hands chosen to be played by the player at the beginning of the round of the game. At this point, the HAND FIVE symbol 105 is highlighted to indicate that HAND FIVE is now being played. The original initial five cards are again re-displayed on the video screen, so that the player has the same starting five cards. As shown in FIG. 11, the video screen again displays the Ace of Spades 111, the Ace of Clubs 112, the King of Spades 113, the King of Clubs 114 and the Six of Clubs 115. The player then chooses which of the cards the player wishes to hold, if any, and which cards the player wishes to discard.

Figure 12:
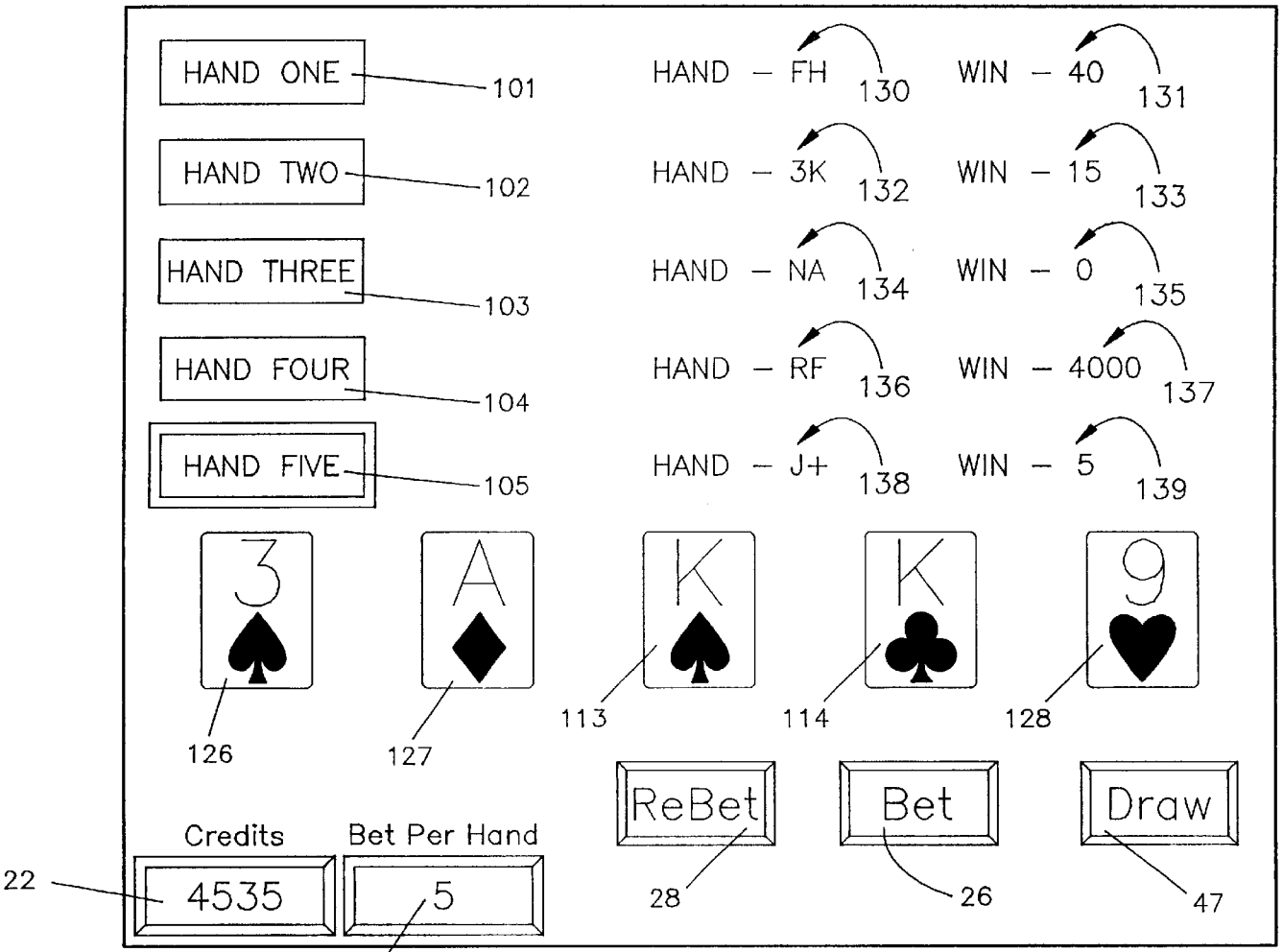
FIG. 12 shows the screen display for Version #1 after replacement cards have been dealt resulting in the final five cards for Hand #5.

Proceeding to FIG. 12, the player has this time held only the King of Spades 113 and the King of Clubs 114. When the replacement cards are dealt, the player received a Three of Spades 126, an Ace of Diamonds 127 and a Nine of Hearts 128. The final five cards of HAND FIVE comprise a Pair of Kings, which is shown on the pay table as a hand of Jacks or Better. Based on a five credit wager on HAND FIVE 105, the player would win five credits for Jacks of Better and the winning amount would be accrued on the credit meter 22. The results of HAND FIVE are shown in an appropriate location on the video screen, such as at location 138 adjacent HAND FIVE symbol 105, and the amount won by the player is also shown at an appropriate location on the video screen, such as at location 139, also adjacent HAND FIVE symbol 105.

On each replay of the initial starting hand, the player may hold none, one or more the five cards. The player can play each starting hand any way the player desires. The player can hold the same cards in each hand or the player can hold different cards in each hand or the player can play some of the hands one way and the other of the hands another way. The player has full freedom to play each in any manner that the player desires.

The preferred embodiment of the present invention describes a method of play in which the player can play the initial five cards up to five times. Alternatively this method of play may be practiced by allowing the player to play the initial five cards from as few as one time to as many times as the gaming establishment wishes to allow the player to so do. The player simply selects at the beginning of each round of the game how many hands the player wishes to play. The selection of the number of hands is made by the player by means of the amount of credits wagered by the player.

While the example of the method of play described above is shown in conjunction with a Double Double Bonus Poker format, the method of play of the present invention can also be applied to any other variation of draw poker, such as regular Draw Poker, Deuces Wild Poker, Bonus Poker, Double Bonus Poker, Triple Bonus Poker, Joker's Wild Poker and the like. Each of these video poker variations uses various arrangements of poker hand rankings as winning combinations.

Version #B: This version is played similarly to Version #A except that the initial starting hand has only three cards. The player holds none, one, two or all three of the initial cards in an attempt to achieve a three card poker hand. Winning hand combinations are provided for the resulting three card combinations and a suitable pay table is presented to the player. Each starting three card hand is replayed the desired number of times based on the selection made by the player at the beginning of each round.

Other variations may be utilized such as four card poker, six card poker, seven card poker or an even higher number of cards in a poker hand. Winning hand combinations are provided for each type of poker hand and a suitable pay table is presented to the player depending on how many cards will be in the final hand.

In each of the preferred embodiments of the present invention, a standard fifty-two card deck of playing cards is used for each deck. One or more cards may also be designated as wild cards and, alternatively, one or more Jokers may be added to the deck of cards and the Jokers may then be used as wild cards.

In each of the preferred embodiments of the present invention, the amount of the player's wager on each hand would be the same. Alternatively, the player could be allowed to make wagers of different amounts on each hand.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) dealing a first hand comprising an initial five cards all face up;

b) selecting none, one or more of the face up cards from the first hand as cards to be held;

c) discarding from the first hand the cards that were not selected to be held and replacing each of those cards with a face up card;

d) determining the poker hand ranking of the resulting cards of the first hand e) redisplaying the initial five cards as a second hand;

f) selecting none, one or more of the face up cards of the redisplayed cards as cards to be held;

g) discarding from the second hand the cards that were not selected to be held and replacing each of those cards with a face up card;

h) determining the poker hand ranking of the resulting cards of the second hand.

2. The method of claim 1 including the steps of:

a) a player making a first wager on the first hand and a second wager on the second hand;

b) paying the player a preestablished amount based on the amount of the first wager if the resulting cards of the first hand comprise a predetermined poker hand ranking; and c) paying the player a preestablished amount based on the amount of the second wager if the resulting cards of the second hand comprise a predetermined poker hand ranking.

3. A method of playing a card game comprising:

a) dealing a first hand comprising an initial five cards all face up;

b) selecting none, one or more of the face up cards from the first hand as cards to be held;

c) discarding from the first hand the cards that were not selected to be held and replacing each of those cards with a face up card;

d) determining the poker hand ranking of the resulting cards of the first hand e) redisplaying the initial five cards as a second hand and subsequent hands;

f) as each of the second hand and subsequent hands are played, selecting none, one or more of the face up cards from the redisplayed cards as cards to be held;

g) discarding from the second hand and subsequent hands the cards that were not selected to be held and replacing each of those cards with a face up card;

h) determining the poker hand ranking of the resulting cards of the second hand and subsequent hands.

4. The method of claim 3 including the steps of:

a) a player making a first wager on the first hand, a second wager on the second hand and additional wagers on each of the subsequent hands;

b) paying the player a preestablished amount based on the amount of the first wager if the resulting cards of the first hand comprise a predetermined poker hand ranking;

c) paying the player a preestablished amount based on the amount of the second wager if the resulting cards of the second hand comprise a predetermined poker hand ranking; and d) paying the player a preestablished amount based on the amount of the subsequent wagers if the resulting cards of the subsequent hands each comprise a predetermined poker hand ranking.

5. A method of playing a card game comprising:

a) dealing a first hand comprising an initial pre-established number of cards all face up;

b) selecting none, one or more of the face up cards from the first hand as cards to be held;

c) discarding from the first hand the cards that were not selected to be held and replacing each of those cards with a face up card;

d) determining the poker hand ranking of the resulting cards of the first hand e) redisplaying the initial pre-established number of cards as a second hand;

f) selecting none, one or more of the face up cards from the redisplayed cards as cards to be held;

g) discarding from the second hand the cards that were not selected to be held and replacing each of those cards with a face up card;

h) determining the poker hand ranking of the resulting cards of the second hand.

6. The method of claim 5 including the steps of:

a) a player making a first wager on the first hand and a second wager on the second hand;

b) paying the player a preestablished amount based on the amount of the first wager if the resulting cards of the first hand comprise a predetermined poker hand ranking; and c) paying the player a preestablished amount based on the amount of the second wager if the resulting cards of the second hand comprise a predetermined poker hand ranking.

7. A method of playing a card game comprising:

a) dealing a first hand comprising at least a pre-established number of cards all face up;

b) selecting none, one or more of the face up cards from the first hand as cards to be held;

c) discarding from the first hand the cards that were not selected to be held and replacing each of those cards with a face up card;

d) determining the poker hand ranking of the resulting cards of the first hand e) redisplaying the initial pre-established number of cards as a second hand and subsequent hands;

f) as each of the second hand and subsequent hands are played, selecting none, one or more of the face up cards from the second hand and subsequent hands as cards to be held;

g) discarding from the second hand and subsequent hands the cards that were not selected to be held and replacing each of those cards with a face up card;

h) determining the poker hand ranking of the resulting cards of the second hand and subsequent hands.

8. The method of claim 7 including the steps of:

a) a player making a first wager on the first hand, a second wager on the second hand and additional wagers on each of the subsequent hands;

b) paying the player a preestablished amount based on the amount of the first wager if the resulting cards of the first hand comprise a predetermined poker hand ranking;

c) paying the player a preestablished amount based on the amount of the second wager if the resulting cards of the second hand comprise a predetermined poker hand ranking; and d) paying the player a preestablished amount based on the amount of the subsequent wagers if the resulting cards of the subsequent hands each comprise a predetermined poker hand ranking.

* * * * *